US008360375B2

(12) United States Patent
Jones

(10) Patent No.: US 8,360,375 B2
(45) Date of Patent: Jan. 29, 2013

(54) ADJUSTABLE LEG SUPPORT

(76) Inventor: Grant B. Jones, Carlsbad, CA (US)

( * ) Notice: Subject to any disclaimer, the term of this patent is extended or adjusted under 35 U.S.C. 154(b) by 0 days.

(21) Appl. No.: 12/925,975

(22) Filed: Nov. 4, 2010

(65) Prior Publication Data

US 2012/0112030 A1 May 10, 2012

(51) Int. Cl.
*A47B 91/00* (2006.01)
*F16M 11/20* (2006.01)

(52) U.S. Cl. ..... 248/188.9; 248/188.1

(58) Field of Classification Search ..... 16/42 T, 16/42 R; 248/188.9, 188.1
See application file for complete search history.

(56) References Cited

U.S. PATENT DOCUMENTS

| | | | | |
|---|---|---|---|---|
| 252,378 | A | 1/1882 | Hoover | |
| 1,348,441 | A | 8/1920 | Perry | |
| 1,389,572 | A | 9/1921 | Berg | |
| 1,402,998 | A | 1/1922 | Anderson | |
| 1,419,835 | A | 6/1922 | Ferch | |
| 2,457,723 | A * | 12/1948 | Pura | 16/32 |
| 2,476,381 | A * | 7/1949 | Peavey | 248/188.4 |
| 2,644,978 | A * | 7/1953 | Becker | 16/42 R |
| 6,363,685 | B1 * | 4/2002 | Kugler | 52/745.05 |
| 6,536,725 | B2 | 3/2003 | Fisher | |
| 6,626,405 | B1 * | 9/2003 | Downen et al. | 248/188.9 |
| 7,404,232 | B2 * | 7/2008 | Chase | 16/42 T |

* cited by examiner

*Primary Examiner* — Amy J Sterling
(74) *Attorney, Agent, or Firm* — Morland C. Fischer

(57) ABSTRACT

An adjustable leg support for providing support to and stabilizing a leg of a table, chair or similar article that is shorter than the other legs to prevent the article from wobbling. The adjustable leg support includes a screw-threaded rotatable base that is detachably coupled in surrounding engagement to a correspondingly threaded platform. The platform has a flat shelf that is laid upon the floor below the short leg to be supported. A rotational force is applied to the rotatable base which causes an axial displacement of the platform upwardly through the base towards the short leg. Rotation of the base continues until the flat shelf of the platform is raised and the short leg is seated on the shelf by which to eliminate the gap between the short leg and the floor. The rotatable base and the platform are mated to one another along opposing sets of screw threads that lie outside and surround the short leg to be stabilized.

16 Claims, 3 Drawing Sheets

ADJUSTABLE LEG SUPPORT

BACKGROUND OF THE INVENTION

1. Field of the Invention

This invention relates to an adjustable leg support for providing support to and stabilizing a leg of a table, or the like, that is shorter than the other legs of the table to prevent the table from wobbling. The adjustable leg support includes a platform that moves axially relative to a rotatable base until the short leg is seated on the platform.

2. Background Art

Often times, one leg of an article, such as a table, desk, chair or the like, is shorter than the other legs. Consequently, the article will wobble which creates an uncomfortable situation for a user. To overcome this inconvenience, it is known to insert a folded napkin or a matchbook between the short leg and the floor to fill the space therebetween. However, such temporary fixes are very unreliable and tend to fail over time, particularly if the short leg is shifted even slightly along the floor. What is more, the aforementioned conventional fixes are not selectively and easily adjustable to accommodate legs of different length. Therefore, such fixes have proven to be unstable especially in cases where there is a large gap between the short leg and the floor.

Leveling devices to selectively adjust the height of a short leg are also known. Such devices often include a flat base and an upstanding threaded post to be attached to the short leg. However, the bottom of all of the legs must first be threaded and/or receive a threaded insert so that the threaded post can be rotated into receipt by any one of the legs.

Other adjustable leveling devices include complementary screw-threaded bodies which are rotated into mating engagement with one another until a gap between a short leg and the floor is filled and eliminated. Because the threaded bodies which extend one above the other are located directly below the short leg, such leveling devices may not be suitable when the gap to be eliminated is very short (e.g., less than ½ inch).

Accordingly, it would be desirable to have available a reliable leg support that is selectively adjustable to stabilize a relatively short leg regardless of the size of the gap between the leg and the floor and without having to make alterations to any of the legs so as to prevent an article with which the short leg is associated from wobbling.

SUMMARY OF THE INVENTION

In general terms, an adjustable leg support is disclosed for providing support to and stabilizing a leg of a table or the like that is shorter than the other legs to prevent the table from wobbling. In a preferred embodiment, the adjustable leg support includes a rotatable base that is detachably coupled in surrounding engagement to an axially-movable platform. The axially-movable platform has a flat shelf that is surrounded by an upstanding cylindrical collar. A set of screw threads extends around the cylindrical collar of the platform. An alignment lip projects outwardly from the collar. The rotatable base of the adjustable leg support includes a cylindrical rim having a set of screw threads extending therearound. A slot or gap is formed in the rotatable base between the cylindrical rim and an outer gripping edge. The rotatable base and the axially-movable platform are coupled together at the respective sets of screw threads that lie opposite one another on the cylindrical rim of the base and the cylindrical collar of the platform. The alignment lip projecting from the cylindrical collar of the axially-movable platform is received in and slidable through the gap formed in the rotatable base so as to facilitate a smooth axial displacement of the platform relative to the base.

In operation, the adjustable leg support is laid on the floor such that the flat shelf of the cylindrical collar of the axially-movable platform is located below the short leg to be stabilized. A rotational force is applied to the outer gripping edge of the rotatable base. A rotation of the base causes a corresponding axial displacement of the platform upwardly through the base towards the short leg. The base is rotated until the flat shelf of the platform is raised and the short leg is seated and supported on the shelf. Accordingly, the adjustable leg support of this invention fills the space between the short leg and the floor to stabilize the leg and prevent the table with which the leg is associated from wobbling.

DESCRIPTION OF THE PREFERRED EMBODIMENT

Figure 2:
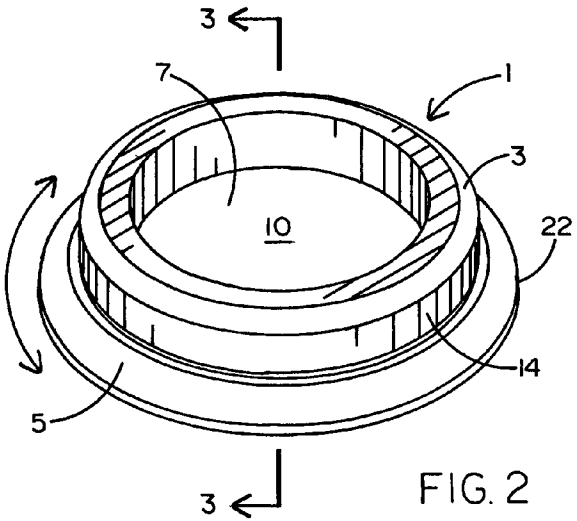
FIG. 2 is a perspective view of the adjustable leg support of FIG. 1.
Figure 1:
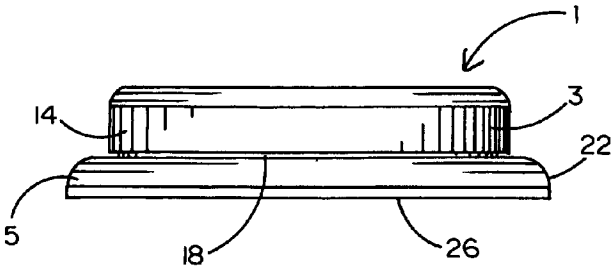
FIG. 1 is a front plan view of an adjustable leg support according to a preferred embodiment of this invention.
Figure 3:
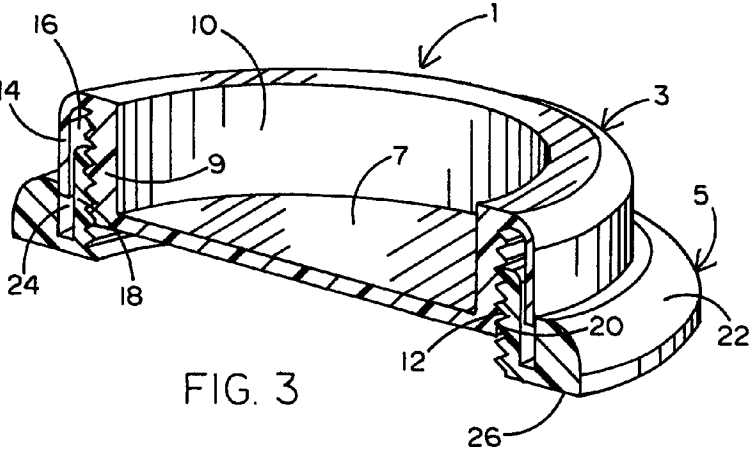
FIG. 3 shows a cross section of the adjustable leg support taken along lines 3-3 of FIG. 2.

Referring concurrently to FIGS. 1-3 of the drawings, there is shown an adjustable leg support 1 having particular application for providing support to and stabilization of a leg of a table that is shorter than the other legs. Although reference has been made to a table leg, it is to be understood that the leg support 1 herein disclosed can be used with other legs such as those associated with a desk, a chair, a bench, and the like. To this end, the leg support 1 is especially useful to compensate for the length of one leg which is shorter than the other legs so that the table will not tilt or wobble as a consequence of not all of the legs having the same length.

In accordance with a preferred embodiment, the adjustable leg support 1 includes an axially-movable platform 3 that is detachably coupled to a rotatable base 5. As is best shown in FIG. 3, the axially-movable platform 3 includes a flat shelf 7 that is surrounded by an inner cylindrical collar 9. The collar 9 stands upwardly from the shelf 7, whereby the shelf is recessed within the axially-movable platform 3 so that a space 10 is created above the shelf 7 within which to receive a relatively short leg in need of support and stabilization. A series of screw threads 12 extends around the outside of the cylindrical collar 9.

An outer alignment lip 14 projects outwardly and bends downwardly from the top of the inner cylindrical collar 9. The lip 14 is spaced radially outward from the collar 9 so that a gap 16 is established therebetween within which the axially-movable platform 3 is coupled to the rotatable base 5 as will soon be described. In particular, the outer alignment lip 14 is separated from (by the gap 16) and surrounds the screw threads 12 which extend around the inner collar 9 of the axially-movable platform 3 of the adjustable leg support 1.

The rotatable base 5 of the adjustable leg support 1 includes an inner cylindrical rim 18 having a series of screw threads 20 extending around the inside thereof. An outer gripping edge 22 projects outwardly and bends upwardly from the bottom of inner rim 18. The gripping edge 22 is spaced radially outward from the rim 18 so that a gap 24 is created therebetween within which to slidably receive the outer alignment lip 14 of the axially-movable platform 3. The bottom 26 of the rotatable base 5 which runs between the bottom of the rim 18 and the gripping edge 22 is flat to lay flush against the floor below the short leg in need of support and stabilization by the adjustable leg support 1 of this invention.

The diameter of the inner cylindrical rim 18 of the rotatable base 5 is slightly larger than the diameter of the inner cylindrical collar 9 of the axially-movable platform 3 of the adjustable leg support 1. The platform 3 is detachably coupled to the base 5 such that the inner cylindrical collar 9 of platform 3 is received inwardly of and is relocated axially through the inner cylindrical rim 18 of base 5 and the screw threads 12 extending around collar 9 lie opposite and in mating engagement with the screw threads 20 which extend around rim 18.

In this same regard, it may be appreciated that a rotational force applied to the outer gripping edge 22 of the rotatable base 5 is transmitted to the inner cylindrical collar 9 of the axially-movable platform 3 at the opposing series of screw threads 20 and 12. Accordingly, the axially-movable platform 3 is displaced upwards or downwards relative to the rotatable base 5 depending upon the direction (i.e., clockwise or counter-clockwise) in which the gripping edge 22 of the rotatable base 5 is rotated. At the same time, the flat shelf 7 that is surrounded by the inner cylindrical collar 9 of platform 3 will correspondingly move upwards or downwards.

Therefore, any space or void below a relatively short table leg (not shown) will be filled after the platform 3 has been displaced axially through the base 5 so that the shelf 7 is moved against the leg. That is to say, the height (i.e., elevation) of the leg support 1 is selectively adjusted until the flat shelf 7 of the platform 3 is moved into position to receive and support the relatively short leg of the table to advantageously avoid table wobbling.

Figure 5:
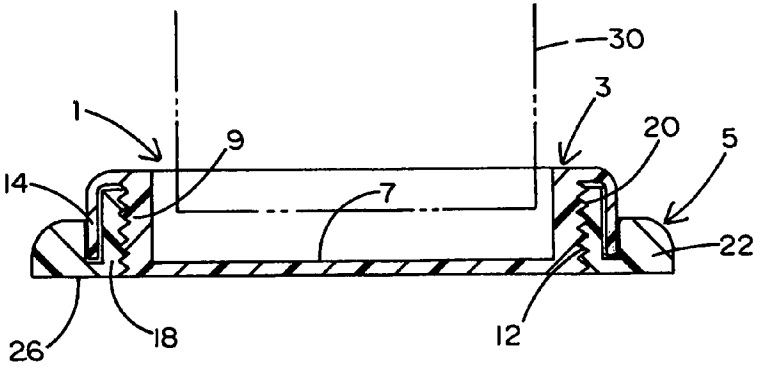
FIGS. 4 and 5 show the adjustable leg support prior to adjustment located below a leg in need of support and stabilization.
Figure 4:
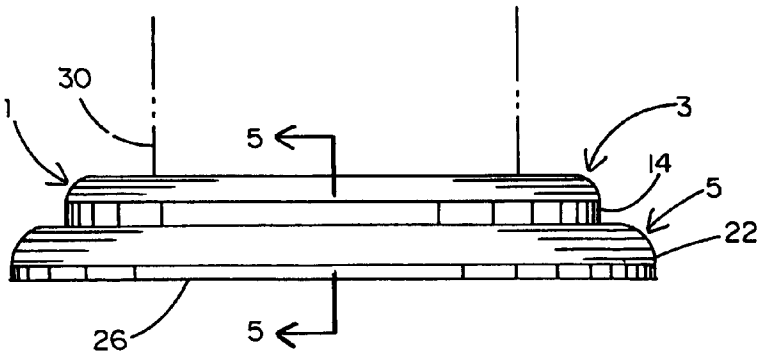

The operation of the adjustable leg support 1 of the present invention to fit between the short leg of the table and the floor and thereby avoid wobbling as just explained is disclosed while referring to FIGS. 4-9 of the drawings. FIGS. 4 and 5 show the axially-movable platform 3 coupled to the rotatable base 5 prior to an adjustment. In this case, the platform 3 is moved downwardly and completely through the base 5. Each of the flat shelf 7 of the platform 3 and the bottom 26 of the base 5 lie against the floor below the short table leg 30 to be supported. The outer alignment lip 14 depending from the inner cylindrical collar 9 of the platform 3 is received inside the gap (designated 24 in FIG. 3) of the base 5 so as to be adapted to guide the platform 3 axially through the base 5 and hold the platform and base 3 and 5 in coaxial alignment with one another.

Figure 7:
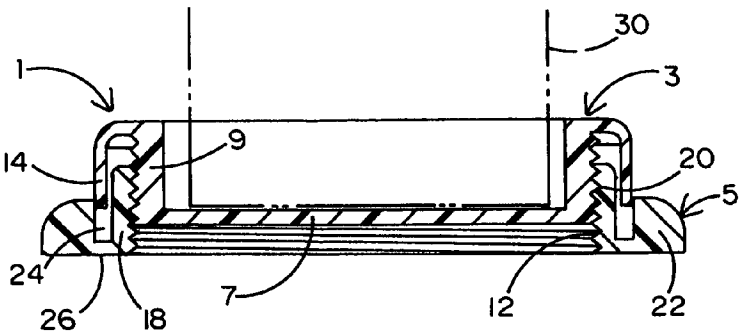
FIGS. 6 and 7 show the adjustable leg support following adjustment to support and stabilize the leg shown in FIGS. 4 and 5.
Figure 6:
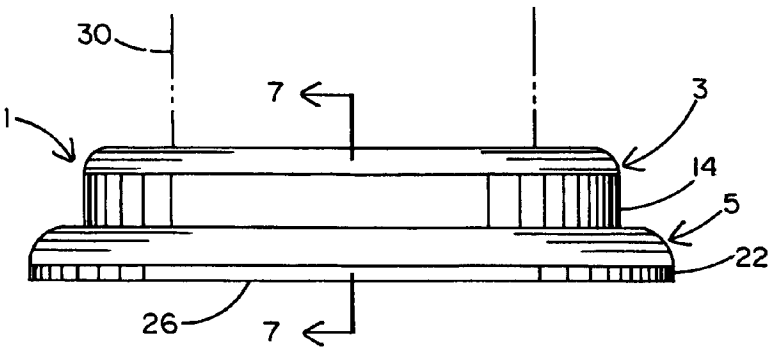

Turning now to FIGS. 6 and 7, the adjustable leg support 1 is adjusted so that the flat shelf 7 of the platform 3 is moved into engagement with the short leg 30 to be supported. The outer gripping edge 22 of the base 5 is readily accessible around the leg in order to receive a rotational force applied thereto. A rotation of the base 5 at gripping edge 22 causes a corresponding axial displacement of the platform 3 upwardly through the base along the opposing series of screw threads 12 and 20. The base 5 is rotated until the inner cylindrical collar 9 is moved off the floor and the flat shelf 7 is raised to lie against the leg 30. The outer alignment lip 14 of the platform 3 is partially withdrawn from the gap 24 so that the platform 3 will be guided smoothly and upwardly through the base 5. As previously explained, the leg 30 is seated on and supported by the elevated shelf 7 to advantageously stabilize the leg and thereby avoid wobbling. Since the shelf 7 is surrounded by the upstanding collar 9, the leg 30 seated on the shelf will be captured and retained within the platform 3 during the axial displacement thereof.

Figure 9:
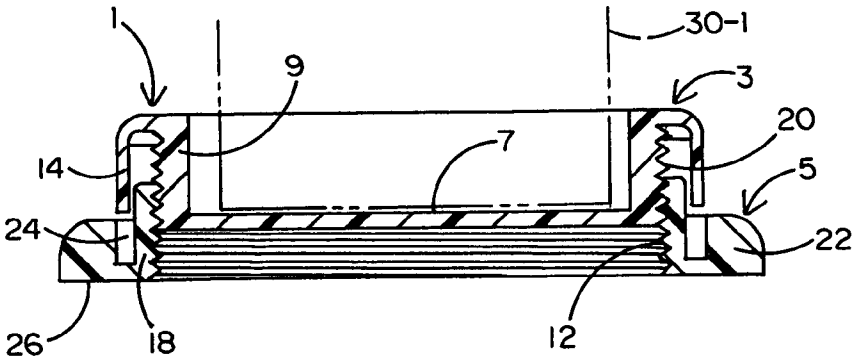
FIGS. 8 and 9 show the adjustable leg support following additional adjustment to support and stabilize a leg that is shorter than the leg of FIGS. 6 and 7.
Figure 8:
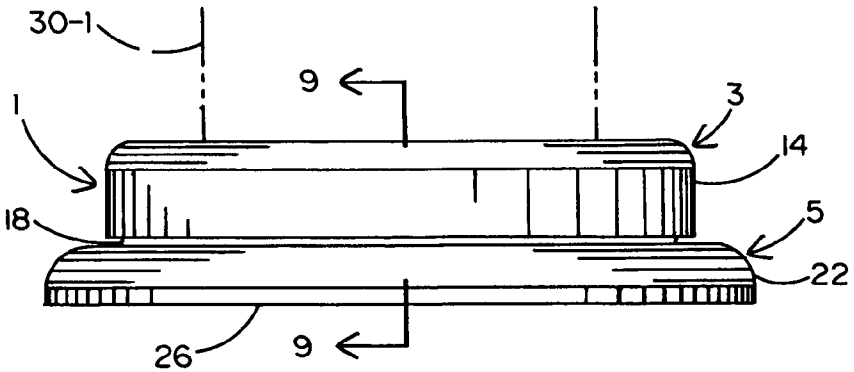

FIGS. 8 and 9 show the adjustable leg support 1 after the base 5 has been rotated at the outer gripping edge 22 to cause the axial displacement of the platform 3 in order to raise the flat shelf 7 into position to support a leg 30-1 that is shorter than the leg 30 shown in FIGS. 4-7. In this case, the flat shelf 7 is raised a greater distance off the floor than the distance to which the shelf 7 is lifted in FIGS. 6 and 7. However, as in FIGS. 6 and 7, with the leg 30-1 seated on and supported by the shelf 7, the leg will be stabilized so that wobbling can be avoided.

It may be appreciated that the screw threads 12 and 20 of the platform 3 and the base 5 of the adjustable leg support 1 lie outside and surround the short leg 30 or 30-1 to be stabilized. Thus, unlike many conventional leveling devices, the bottoms of all of the legs need not be threaded to receive a threaded insert, or the like. What is more, the height of the threads 12 and 20 does not interfere with the leg support 1 being used to fill very small gaps between the short leg and the floor.

The invention claimed is:

1. An adjustable support for stabilizing a relatively short leg of an article having other legs which are longer than the short leg so that the article will not wobble, said adjustable support comprising:

a rotatable base having a bottom to lie flush against a floor below the relatively short leg to be stabilized, said base having a passageway that extends axially and completely through said base to the floor and a platform guide surface that surrounds said passageway; and an axially-movable platform being coupled to said rotatable base at the platform guide surface of said base, said axially-movable platform having a leg supporting surface that is positionable below the short leg, such that a rotational force applied to said rotatable base causes a corresponding axial displacement of said axially-movable platform along the platform guide surface of said base, whereby said axially-movable platform moves upwardly and downwardly through the passageway of said base between a first location lying flush against the floor and a second location lying above the floor until the leg supporting surface of said platform moves into engagement with and supports the short leg.

2. The adjustable support recited in claim 1, wherein said axially-movable platform is surrounded by the platform guide surface of said rotatable base and said axially movable platform surrounds the relatively short leg.

3. The adjustable support recited in claim 2, wherein said axially-movable platform is coupled to the platform guide surface of said rotatable base at respective opposing sets of screw threads extending therearound.

4. The adjustable support recited in claim 1, wherein the leg supporting surface of said axial platform is a flat shelf upon which the relatively short leg is seated when said leg supporting surface is moved into engagement with the short leg.

5. The adjustable support recited in claim 1, wherein said axially-movable platform includes a lip spaced outwardly from said leg supporting surface thereof and said rotatable base has a slot formed therein, the lip of said platform sliding axially through the slot of said base as said platform moves downwardly through the passageway of said base to said first location flush against the floor.

6. The adjustable support recited in claim 1, wherein said axial-movable platform includes a cylindrical collar that surrounds and stands upwardly from said leg supporting surface.

7. The adjustable support recited in claim 6, wherein the platform guide surface of said rotatable base includes a cylindrical rim that is located in surrounding engagement with the cylindrical collar of said axially-movable platform.

8. The adjustable support recited in claim 7, wherein each of the cylindrical rim of said rotatable base and the cylindrical collar of said axially-movable platform has a set of screw threads extending therearound and lying in opposing mating engagement with each other so that the rotational force applied to said base causes the corresponding axial displacement of said platform upwardly and downwardly through the passageway of said base surrounded by the cylindrical rim of said base.

9. The adjustable support recited in claim 7, wherein the cylindrical collar of said axially-movable platform and the cylindrical rim of said rotatable base are coaxially aligned with one another, said cylindrical collar moving axially and completely through the passageway of said base in response to the rotational force applied to said rotatable base.

10. An adjustable support for stabilizing a relatively short leg of an article having other legs which are longer than the short leg so that the article will not wobble, said adjustable support comprising:

an inner platform having a leg supporting surface that is positionable below the relatively short leg; and an outer rotatable base that is coupled in surrounding engagement to said inner platform, said outer rotatable base having a flat bottom to lie flush against a floor below the relatively short leg to be stabilized, said base also having a rim that stands upwardly from said flat bottom and a passageway that extends axially and completely through said base to the floor such that said rim surrounds said passageway, said inner platform and the rim of said outer rotatable base having respective sets of screw threads that lie in opposing mating engagement with one another, such that a rotational force applied to said rotatable base causes a corresponding axial displacement of said inner platform through the passageway of said base surrounded by the rim of said base between a first location lying flush against the floor and a second location lying above the floor until the leg supporting surface of said platform moves into engagement with and supports the short leg.

11. The adjustable support recited in claim 10, wherein said inner platform includes a flat shelf and a cylindrical collar surrounding said shelf upon which the relatively short leg is seated when said leg supporting surface is moved into engagement with the short leg.

12. The adjustable support recited in claim 11, wherein the set of screw threads of said inner platform extend around the cylindrical collar thereof, and the screw threads of said rotatable base extend around the upstanding rim thereof and lie in said opposing mating engagement with the screw threads around the cylindrical collar of said inner platform, such that said upstanding rim and said cylindrical collar are coaxially aligned with respect to one another.

13. The adjustable support recited in claim 11, wherein said inner platform also includes an alignment lip projecting outwardly from said cylindrical collar thereof, and said outer rotatable base has a slot formed therein, the alignment lip of said platform sliding through the slot of said base as said platform is displaced axially through the passageway of said base to said first location flush against the floor.

14. The adjustable support recited in claim 10, wherein said outer rotatable base and said inner platform are detachably connected to one another at said respective sets of screw threads thereof.

15. The adjustable support recited in claim 10, wherein said outer rotatable base has a gripping surface to receive said rotational force, said gripping surface being spaced outwardly from and surrounding the upstanding rim of said base.

16. An adjustable support for stabilizing a relatively short leg of an article having other legs which are longer than the short leg so that the article will not wobble, said adjustable support comprising:

a rotatable base to lie on a floor and having a passageway extending completely through the base to the floor, and an axially-movable platform being coupled to said rotatable base, said axially-movable platform having a leg supporting surface that is positionable below the short leg to be stabilized and a cylindrical collar that surrounds and stands upwardly from said leg supporting surface for receipt within the passageway of said base, such that a rotational force applied to said rotatable base causes a corresponding axial displacement of the cylindrical collar of said axially-movable platform through the passageway of said base until the leg supporting surface of said platform reaches the floor, the position of said cylindrical collar being selectively adjustable within the passageway of said base, whereby the leg supporting surface of said platform moves into engagement with and supports the short leg.

* * * * *